US007514121B2

(12) United States Patent
Williams

(10) Patent No.: US 7,514,121 B2
(45) Date of Patent: Apr. 7, 2009

(54) METHOD OF MAKING A GLOVE WITH GRIPPING DOTS

(76) Inventor: Cole Williams, 8475 NE. County Park Rd., Bainbridge Island, WA (US) 98110

( * ) Notice: Subject to any disclaimer, the term of this patent is extended or adjusted under 35 U.S.C. 154(b) by 654 days.

(21) Appl. No.: 11/209,272

(22) Filed: Aug. 22, 2005

(65) Prior Publication Data

US 2007/0039083 A1 Feb. 22, 2007

Related U.S. Application Data

(63) Continuation-in-part of application No. 11/187,092, filed on Jul. 22, 2005, now Pat. No. 7,229,670.

(51) Int. Cl.

| | |
|---|---|
| ***B05D 7/00*** | (2006.01) |
| ***B05D 3/00*** | (2006.01) |
| ***B05D 3/06*** | (2006.01) |
| *B05D 5/00* | (2006.01) |
| *B05D 1/32* | (2006.01) |
| *A41D 19/00* | (2006.01) |

(52) U.S. Cl. ..... 427/288; 427/510; 427/513; 427/389.9

(58) Field of Classification Search ..... None
See application file for complete search history.

(56) References Cited

U.S. PATENT DOCUMENTS

| | | | | | |
|---|---|---|---|---|---|
| RE22,167 | E | * | 8/1942 | Wells et al. | 2/161.8 |
| 3,934,062 | A | * | 1/1976 | Tillotson et al. | 427/185 |
| 4,259,377 | A | * | 3/1981 | Baize | 427/346 |
| 5,500,956 | A | * | 3/1996 | Schulkin et al. | 2/161.1 |
| 5,625,900 | A | * | 5/1997 | Hayes | 2/161.8 |
| 5,655,226 | A | | 8/1997 | Williams | |
| 6,185,747 | B1 | * | 2/2001 | Hughes | 2/161.6 |
| 6,591,427 | B1 | * | 7/2003 | Bennett | 2/161.8 |

* cited by examiner

*Primary Examiner*—William Phillip Fletcher, III

(57) ABSTRACT

A method of making an improved glove including the steps of: knitting a glove having a back portion, a palm portion, and a thumb portion, the thumb portion having first and second opposing surfaces; placing the glove over a hand-shaped form having a palm portion and a thumb portion; rotating the thumb portion of the glove about the thumb portion of the hand-shaped form to form a rotated thumb portion; depositing a multiplicity of dots of a polymer emulsion on the palm portion and the rotated thumb portion of said glove to form an uncured first precursor; curing the dots of polymer emulsion to form a cured precursor; and removing the cured precursor from the form.

11 Claims, 6 Drawing Sheets

METHOD OF MAKING A GLOVE WITH GRIPPING DOTS

This is a continuation-in-part of U.S. application Ser. No. 11/187,092 filed Jul. 22, 2005 (now U.S. Pat. No. 7,229,670 B2).

BACKGROUND OF THE INVENTION

1. Field of the Invention

The present invention relates generally to articles of apparel and methods for making the same. More particularly, the invention concerns an improved glove having a multiplicity of strategically located gripping dots formed thereon.

2. Discussion of the Prior Art

Gloves of various constructions have been suggested in the past and have been used for work and for numerous recreational activities such as driving, shooting, ice-skating, skiing, motorcycling and a wide variety of indoor and outdoor activities. Typically, such gloves are made from leather as well as several different types of treated, relatively hard surfaced fabrics. Attempts have also been made in the past to produce knitted gloves that will enable the user to securely grip and efficiently manipulate various types of articles. While a number of different designs of knitted gloves have been suggested, most are not well suited for conducting many types of sporting activities and for manipulating various types of articles.

Knit gloves made on modern automatic glove knitting machines are generally produced in an ambidextrous or symmetrical pattern. However, once gripping dots have been applied to one side of the glove, the glove is no longer ambidextrous and instead becomes hand specific. When wearing a glove made in accordance with this method, undesirably the printed area on the thumb portion of the glove does not completely oppose the printed area on the index finger portion of the glove. It is this problem that the present invention seeks to overcome by providing a novel method for applying gripping dots to the knitted glove in a manner to ensure that the gripping dots imprinted on the thumb portion of the glove properly align with the gripping dots imprinted on the index finger portion of the glove.

One prior art, fully waterproof glove construction is described in U.S. Pat. No. 5,655,226 issued to the present inventor. This glove, which is slightly more bulky than the gloves of the present invention, comprises a three-ply glove construction with the inside and outside plies being knit and the intermediate ply being made from an elastomeric polyurethane film. The three plies are uniquely bonded together using a pliant, waterproof adhesive. The glove described in the '226 patent is not only waterproof but is also breathable so that water vapor from perspiration can be transmitted from inside to outside. For activities that do not require that the glove be absolutely waterproof, the glove of the present invention provides an attractive alternate.

As will be better understood from the description that follows, the novel glove of the present invention is provided with gripping dots on the palm portion of the glove and on opposing surfaces of the thumb portion of the glove so that when the glove is in position on the hand of the user and when the thumb and index finger are moved together, the grip dots located on the index finger of the glove will engage the grip dots located on the thumb portion of the glove. With this unique construction, the ability of the user to grip and manipulate a variety of differently configured objects and particularly to grip and manipulate objects between the thumb and the index finger is greatly enhanced. Additionally, the glove of the invention is durable, easy to don and comfortable to wear.

SUMMARY OF THE INVENTION

It is an object of the present invention to provide an improved glove that significantly enhances the ability of the user to grip and manipulate a variety of differently configured objects and particularly to grip and manipulate objects between the thumb and the index finger.

Another object of the invention is to provide an improved glove of the aforementioned character that is easy to don and comfortable to wear.

Another object of the invention is to provide a glove of the character described in the preceding paragraphs that exhibits a multiplicity of elastomeric gripping dots on the palm side of the glove and on both sides of the thumb portion of the glove to enable the user to securely grip and manipulate various types of articles.

Another object of the invention is to provide a method of making a glove of the character described in the preceding paragraphs which is simple and straightforward, does not require the use of complicated equipment such as sewing and seaming equipment and can be performed by unskilled workmen with a minimum of training.

Another object of the invention is to provide a glove as described in the preceding paragraphs that is of simple construction and is easy and inexpensive to manufacture.

By way of summary, one form of the method of the invention for making the glove comprises the steps of knitting a knitted glove that includes a palm surface and an opposing back surface and then placing the knitted glove over a generally hand-shaped mandrel having a palm portion and a thumb portion to form a knitted glove assembly. With the glove in position over the mandrel, the thumb portion of the knitted glove is rotated about the thumb portion of the generally hand-shaped mandrel to expose front and back surfaces of thumb portion. A specially constructed stencil having a multiplicity of apertures therethrough is then placed over the knitted glove assembly. Next, a multiplicity of dots of a curable polymer emulsion, such as a polyvinyl chloride emulsion, are deposited on the palm surface of the stretched knitted glove and on the now exposed front and back surfaces of the thumb portion by forcing the emulsion through the apertures formed in the stencil to form an uncured first precursor. Then, using an appropriate curing means, the multiplicity of dots of the curable polymer emulsion deposited on the glove are cured to form a cured precursor. Finally, the cured precursor is removed from the mandrel.

DISCUSSION OF THE INVENTION

Figure 1:
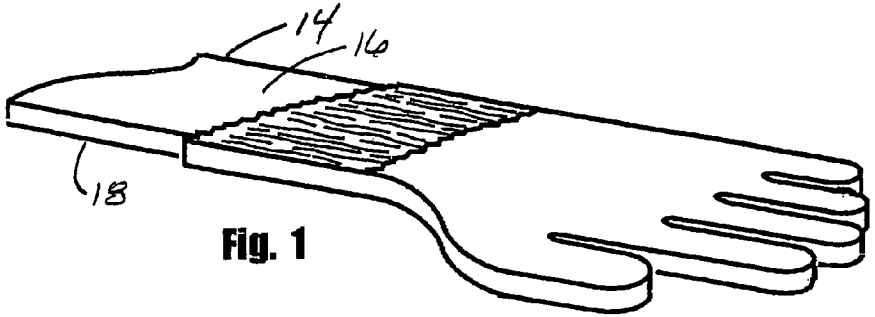
FIG. 1 is a generally perspective view showing a knitted glove emplaced over the generally hand-shaped form, or mandrel of the apparatus of the invention.
Figure 2:
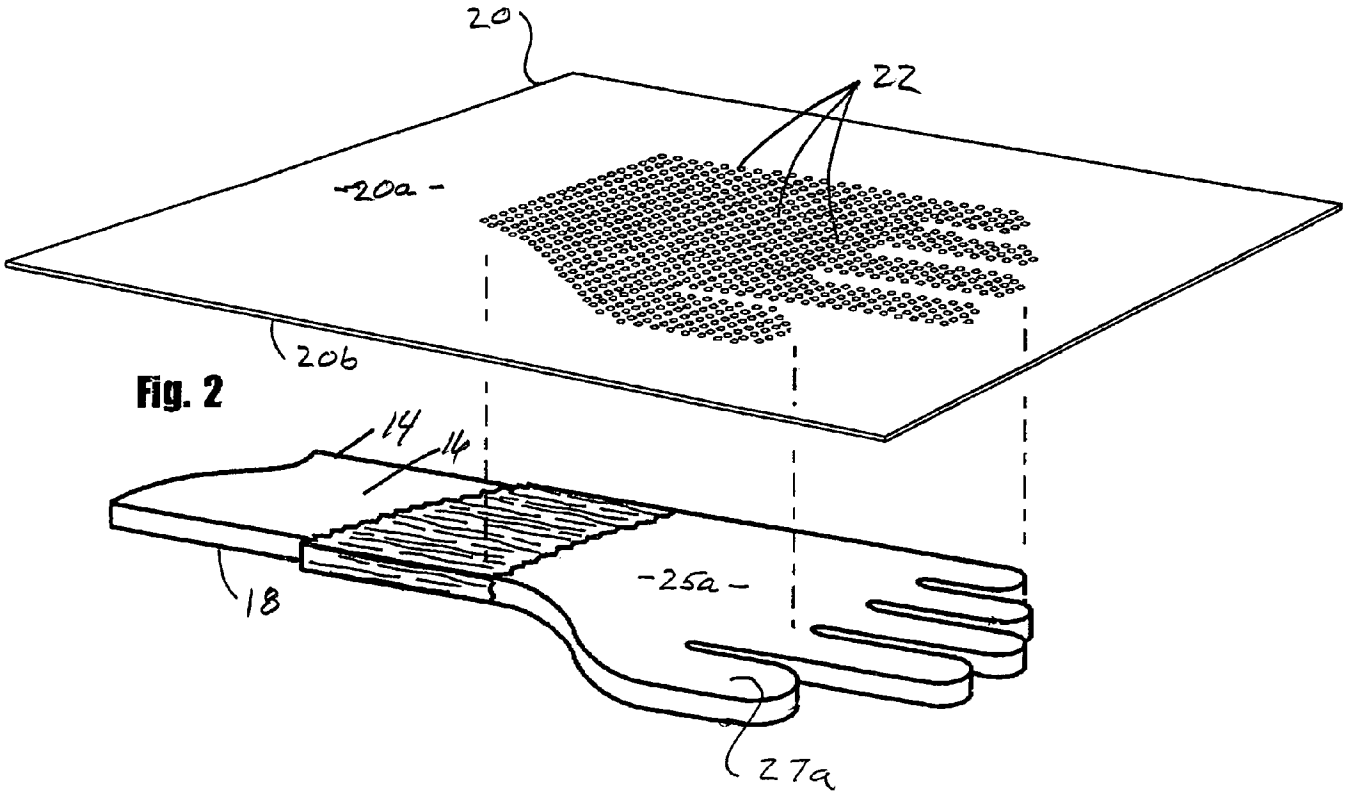
FIG. 2 is a generally perspective, exploded view showing the stencil component of the apparatus of the invention superimposed over the assemblage shown in FIG. 1.
Figure 3:
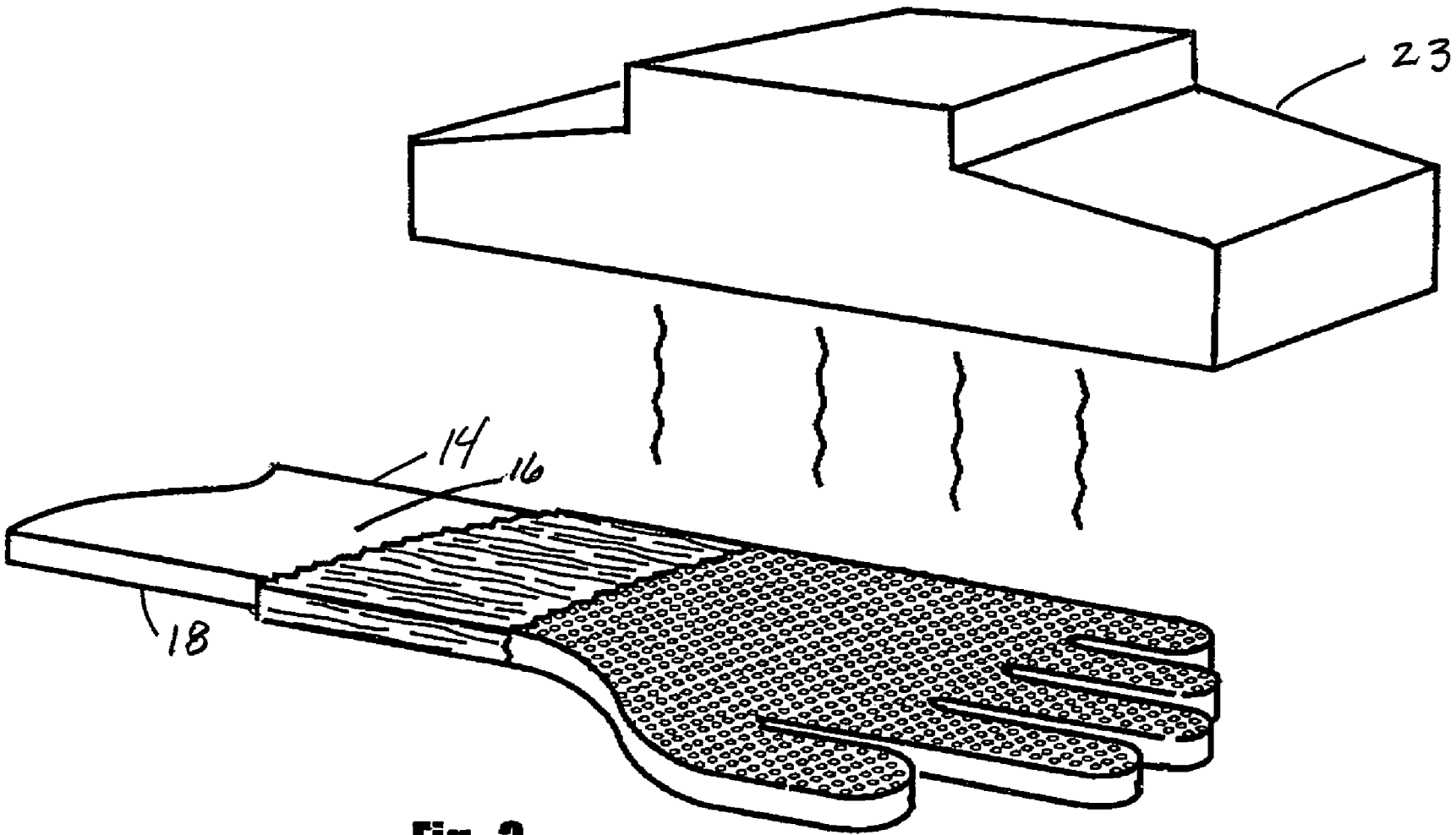
FIG. 3 is a generally perspective, diagrammatic view showing the curing or irradiation means of the apparatus of the invention superimposed over the assemblage of FIG. 1 as it appears following the deposition of a multiplicity of gripping dots on the palm surface of the stretchable glove.

Referring to the drawings and particularly to FIGS. 1, 2 and 3, one form of the apparatus of the invention for making an improved gripping glove is there illustrated. In the present form of the invention, the apparatus comprises a substantially rigid, aluminum form 14, which has the general shape of a human hand. Form, or mandrel 14 has a first, generally planar surface 16 and a second, spaced-apart generally planar, opposing surface 18.

Also forming a part of the apparatus of the present invention is substantially rigid stencil component 20 that has generally planar, spaced-apart opposing surfaces 20*a* and 20*b*. As seen in FIG. 2 stencil 20 is provided with a multiplicity of spaced-apart generally dot size apertures 22 therethrough.

Turning to FIG. 3, it can be seen that the apparatus of the invention also includes curing, or irradiation means, generally designated by the numeral 23, for irradiating the precursor assemblies of the invention. The character of this important irradiation means will presently be described.

Figure 4:
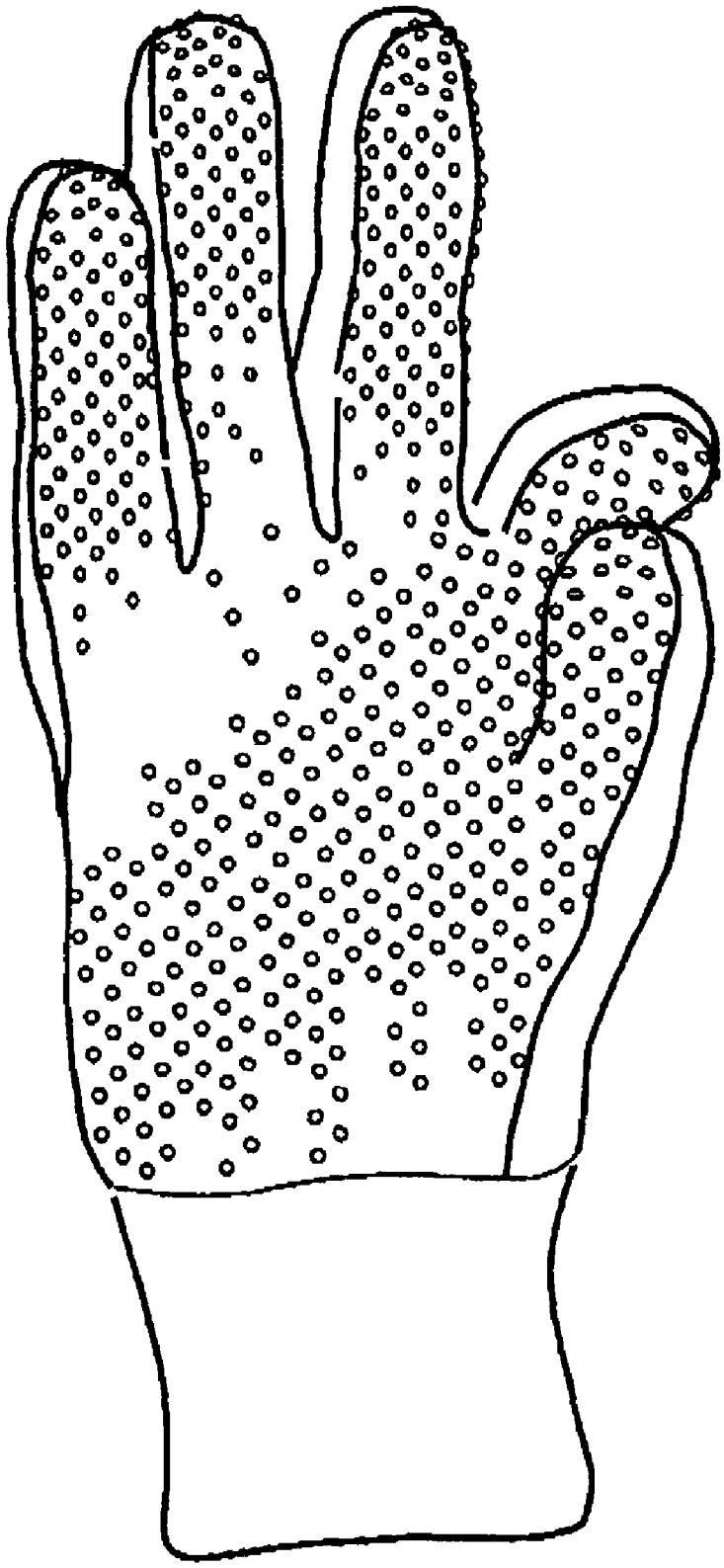
FIG. 4 is a generally perspective view of a knitted glove of FIG. 3 having the cured gripping dots printed on the palm surface of the glove and on one surface of the untwisted thumb portion of the glove and illustrating the mismatch of the grip dot pattern on the thumb and the index finger portions of the glove.

By way of illustration, FIGS. 1 and 2 show a method of making a gripping glove, such as that illustrated in FIG. 4, in which the gripping dots on the index finger of the printed glove misalign with the gripping dots provided on the thumb portion of the glove. In this example, the knitted glove has been emplaced over the mandrel 18 in the manner shown in FIG. 1 with the thumb portion 27 of the glove in a non-rotated, or non-twisted configuration. With the glove in this position, a multiplicity of dots of a polymer emulsion, such as a polyvinyl chloride emulsion, can be deposited on the palm surface 25*a* of the glove and on the exposed surface 27*a* of the non-rotated thumb portion of the glove by forcing the emulsion through the apertures 22 that extend through the stencil. The dots of polymer thusly deposited can then be cured using the curing means 23 illustrated in FIG. 3 of the drawings to produce the glove construction illustrated in FIG. 4 of the drawings wherein the gripping dots exhibit a rubber-like consistency. As illustrated in FIG. 4, when the index finger of the glove is moved into engagement with the thumb portion of the glove the gripping dots on the index finger undesirably misalign with the gripping dots on the thumb portion of the glove making it difficult to grip and manipulate articles between the thumb and index finger. It is this deficiency of the glove made in accordance with the method illustrated in FIGS. 1, 2 and 3 that the novel method of the present invention seeks to overcome.

Figure 5:
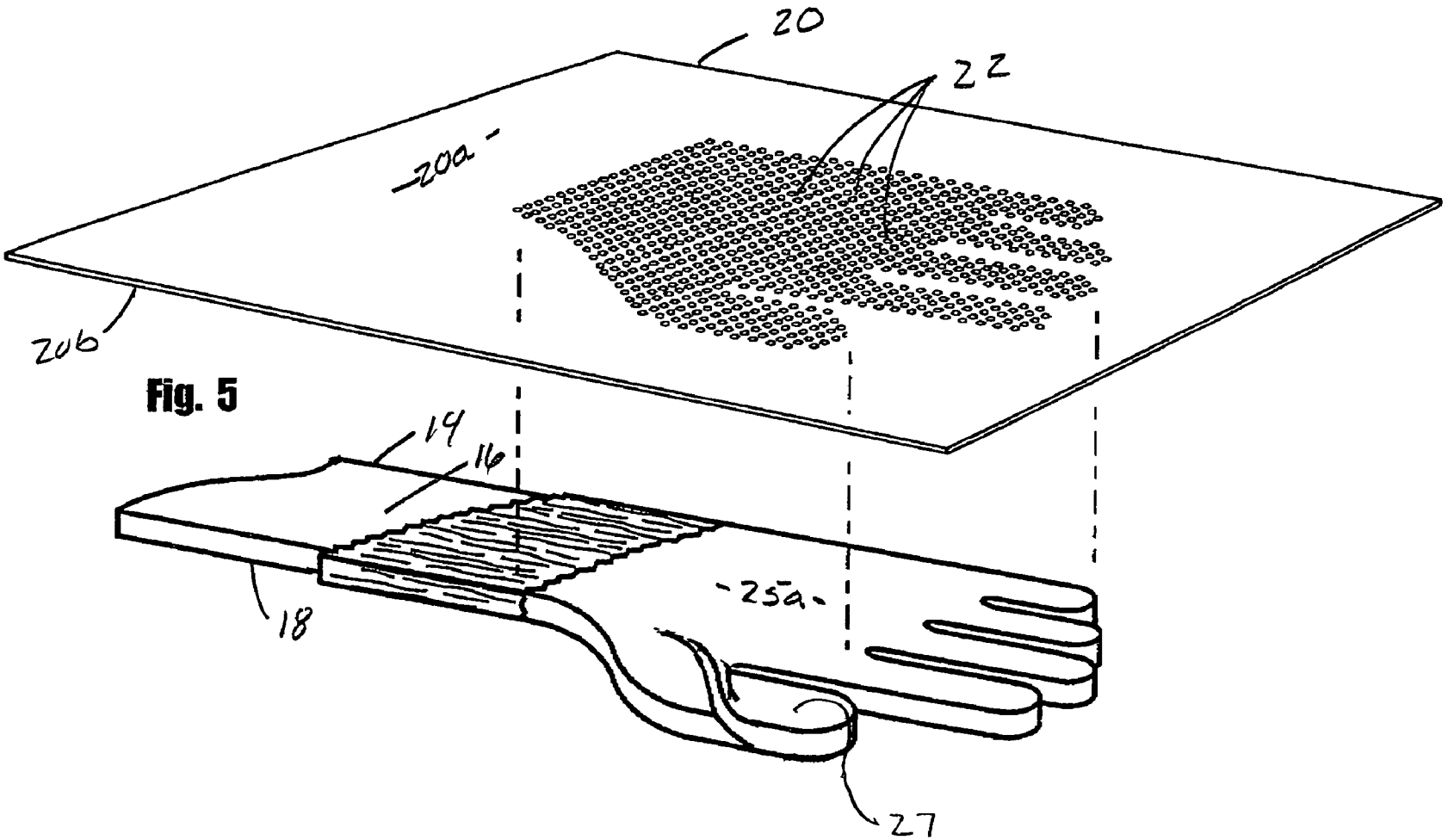
FIG. 5 is a top plan view illustrating a glove stretched over an aluminum mandrel with the thumb portion of the glove having been rotated about the thumb portion of the mandrel in accordance with the method of the present invention and showing the stencil component of the apparatus of the invention superimposed over the twisted thumb assemblage.
Figure 6:
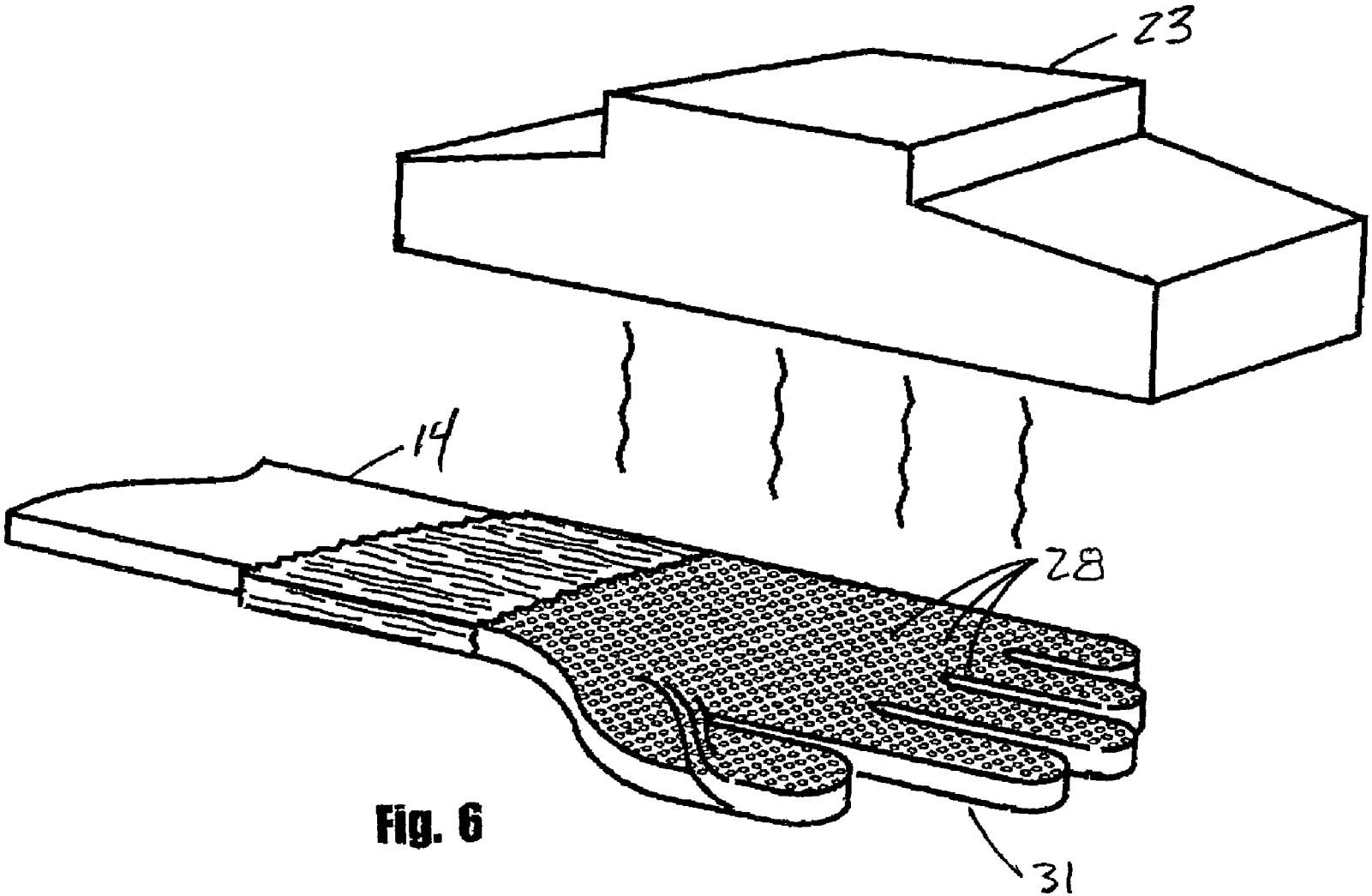
FIG. 6 is a generally perspective, diagrammatic view showing the curing or irradiation means of the apparatus of the invention superimposed over the assemblage of the lower portion of FIG. 5 as it appears following the deposition of a multiplicity of gripping dots on the palm surface of the stretchable glove and on the opposing surfaces of the twisted thumb portion of the glove.
Figure 7:
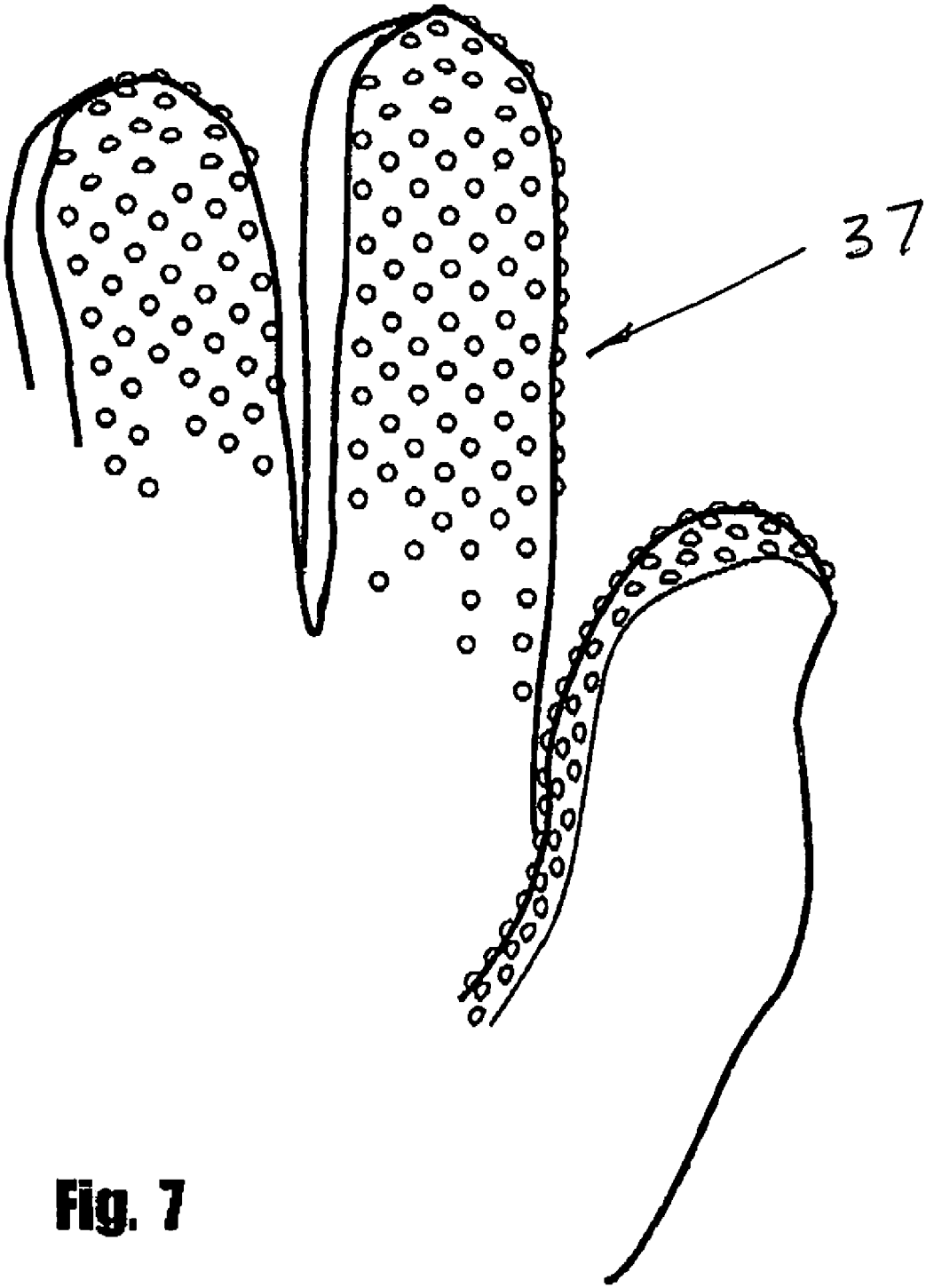
FIG. 7 is an enlarged fragmentary plan view of the twisted thumb portion of the imprinted glove illustrating the imprinting of the gripping dots on the opposing surfaces of the thumb portion of the glove.

Turning to FIGS. 5 through 7 of the drawings, the method of the present invention that overcomes the deficiency discussed in the preceding paragraph is there illustrated. The first step in this novel method is to knit, in a conventional manner well understood by those skilled in the art, a knit glove comprising a hand covering portion having a palm portion, a thumb portion and an index finger portion. Preferably, the glove, is knitted using a readily commercially available stretchable fiber. The knit glove thus formed is then emplaced over the mandrel 14 with the palm side 25*a* facing up. Next, as illustrated in FIG. 5, the thumb portion of the glove is rotated relative to the thumb portion of the mandrel so that the back portion of the thumb surface 27 is now positioned on the front side of the mandrel.

With the glove in position over the form 14, the next step in the method of the invention is to superimpose the stencil 20 over the palm and twisted thumb portions of the glove in the manner illustrated in FIG. 5. With the stencil 20 indexedly aligned with the glove, a multiplicity of dots 28 of a polymer emulsion, such as a liquid vinyl emulsion (FIG. 6), are deposited on the palm and twisted thumb surfaces of the stretched glove by forcing the emulsion through the apertures 22 to form an uncured precursor. After the polymer emulsion is forced through the apertures 22 through the use of a squeegee or any other suitable instrumentality (not shown), the dots 28 that are formed are converted from a paste-like consistency into a rubber-like, semi-rigid consistency and are temporarily bonded to the surfaces 25*a* and 27.

Following the dot formation step to form the uncured precursor 31, the polymer dots, such as the polyvinyl chloride emulsion dots 28 are suitably cured. This curing (fusing or conversion) of the dots may be done by exposing the uncured dots to a suitable radiation such as is emitted from the radiation means, or irradiation device 23 of the invention (see FIG. 6). The radiation means can comprise either an irradiation device that produces infrared heat or an irradiation device that produces ultraviolet light depending on the formulation of the emulsion. When certain emulsions are used, the radiation means can also comprise a conventional heating means for controllably heating the uncured emulsion. Radiation means, such as device 23, are well known to those skilled in the art and are readily commercially available.

It is to be understood that in practice the uncured precursor 31 could be positioned on a conveyor belt and passed beneath the irradiation means in a manner to cure the dots 28.

Following the curing step, the glove is removed from the form 14. As depicted in FIG. 7 when the printed glove 37 is removed from the form, the dots provided on the surfaces of the thumb portion of the glove effectively align with the dots provided on the surfaces of the index finger portion of the glove. The unique grip dot pattern provided on the finished glove provides improved gripping characteristics both when the glove is wet and when the glove is dry compared to the grip obtainable from bare hands. More particularly, the improved glove of the invention significantly enhances the ability of the user to grip and manipulate objects between the thumb and the index finger. The novel dot pattern also makes the finished glove extremely durable and substantially abrasion resistant.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making a glove having gripping surfaces using a shaped form having a palm portion and a thumb portion, said method comprising the steps of:

(a) knitting a glove having a back portion, a palm portion and a thumb portion, said thumb portion having first and second opposing surfaces;

(b) placing said glove over the form;

(c) rotating the thumb portion of the glove about the thumb portion of the hand-shaped form to form a rotated thumb portion;

(d) depositing a multiplicity of dots of a polymer emulsion on said palm portion and said rotated thumb portion of said glove to form an uncured first precursor;

(e) curing said dots of polymer emulsion to form a cured precursor; and (f) removing said cured precursor from said form.

2. The method as defined in claim 1 in which said form comprises a hand-shaped mandrel having spaced-apart first and second, generally planar opposing surfaces.

3. The method as defined in claim 1 in which said dots of polymer emulsion are cured by ultraviolet radiation.

4. The method as defined in claim 1 in which said plurality of gripping dots are formed from a vinyl material.

5. The method as described in claim 1 in which the multiplicity of dots of polymer emulsion are deposited on said palm portion and said rotated thumb portion of said glove cover a surface area of less than 25% of the total surface said palm portion and said rotated thumb portion.

6. The method as defined in claim 1 in which said polymer emulsion comprises a liquid vinyl material.

7. The method as described in claim 6 in which a multiplicity of dots of polymer emulsion deposited on said palm portion and said rotated thumb portion of said glove cover a surface area of less than 25% of the total surface said palm portion and said rotated thumb portion.

8. A method of making an ambidextrous glove having gripping surfaces using a hand-shaped mandrel form having a palm portion and a thumb portion, said method comprising the steps of:

(a) knitting a glove having a back portion, a palm portion, and a thumb portion, said thumb portion having first and second opposing surfaces;

(b) placing said glove over the mandrel;

(c) rotating the thumb portion of the glove about the thumb portion of the hand-shaped mandrel to form a rotated thumb portion;

(d) depositing a multiplicity of dots of a polymer emulsion on said palm portion and said rotated thumb portion of said ambidextrous glove to form an uncured first precursor;

(e) curing said dots of polymer emulsion to form a cured precursor; and (f) removing said cured precursor from said mandrel.

9. The method as defined in claim 8 in which said hand-shaped mandrel comprises an aluminum mandrel having spaced-apart first and second, generally planar opposing surfaces.

10. The method as defined in claim 8 in which said dots of polymer emulsion are cured by ultraviolet radiation.

11. The method as defined in claim 8 in which said dots of polymer emulsion are cured by infrared radiation.

* * * * *